US006427298B1

(12) United States Patent
Tseng

(10) Patent No.: US 6,427,298 B1
(45) Date of Patent: Aug. 6, 2002

(54) SHOELACE ANGLET

(75) Inventor: Tony Tseng, Chang Hua Tsien (TW)

(73) Assignee: Taiwan Paiho Limited, Chang Hua Tsien (TW)

( * ) Notice: Subject to any disclaimer, the term of this patent is extended or adjusted under 35 U.S.C. 154(b) by 0 days.

(21) Appl. No.: 09/909,721

(22) Filed: Jul. 19, 2001

(51) Int. Cl.[7] ..... A44B 21/00; A43C 9/04

(52) U.S. Cl. ..... 24/715.4; 24/712; 24/712.1; 24/713.3; 24/715.1

(58) Field of Search ..... 24/715.4, 715.1, 24/713.3, 712, 712.1, 300; 36/50.1

(56) References Cited

U.S. PATENT DOCUMENTS 3,636,594 A * 1/1972 Faivre ..... 24/715.4
5,293,675 A * 3/1994 Shai ..... 24/712.1
5,638,589 A * 6/1997 Phillips ..... 24/715.4
6,016,590 A * 1/2000 Malone ..... 24/712.1
6,338,186 B1 * 1/2002 Kleinmann ..... 24/712.1

* cited by examiner

*Primary Examiner*—Victor Sakran
(74) *Attorney, Agent, or Firm*—Pro-Techtor International Services

(57) ABSTRACT

A shoelace anglet having a front opening at one end thereof, a rounded head at an opposite end thereof, an end slot in the rounded head, a split extended between the end slot and the front opening, at least one protruding portion disposed at a first side of the split, and at least one recessed portion disposed at a second side of the split and adapted to receive the at least one protruding portion respectively.

6 Claims, 7 Drawing Sheets

SHOELACE ANGLET

BACKGROUND OF THE INVENTION

The present invention relates to shoelaces and, more particularly, to anglets for shoelaces, which are prohibited from hooking up with each other when installed in the ends of the shoelace of a shoe.

Conventional shoelace anglets are commonly injection-molded from plastics. During installation, the shoelace anglet is internally covered with a layer of acetone, and then attached to the end of the shoelace, and then fixedly secured thereto by a heat press. This structure of plastic anglet is not durable in use, and tends to be removed from the shoelace when stretched. In order to eliminate these drawbacks, metal shoelace anglets are developed. A regular metal shoelace anglet comprises a front opening at one end, a rounded head at the other end, a crossed end slot in the rounded head, and a longitudinal split extended between the crossed end slot and the front opening. This structure of metal shoelace anglet is durable in use. However, the metal shoelace anglets may hook up with one another when put together during after fabrication or during surface treatment.

SUMMARY OF THE INVENTION

The present invention has been accomplished to provide a metal shoelace anglet, which eliminates the aforesaid drawbacks. It is one object of the present invention to provide shoelace anglets for shoes, which are easy and inexpensive to manufacture. It is another object of the present invention to provide shoelace anglets for shoes, which are durable in use. It is still another object of the present invention to provide shoelace anglets for shoes, which do not hook up with one another when put together. According to the present invention, the shoelace anglet has a front opening at one end thereof, a rounded head at an opposite end thereof, an end slot in the rounded head, a split extended between the end slot and the front opening, at least one protruding portion disposed at a first side of the split, and at least one recessed portion disposed at a second side of the split and adapted to receive the at least one protruding portion respectively. Because the at least one protruding portion respectively project into the at least one recessed portion, shoelace anglets do not hook up with one another when put together.

DETAILED DESCRIPTION OF THE PREFERRED EMBODIMENT

Figure 1:
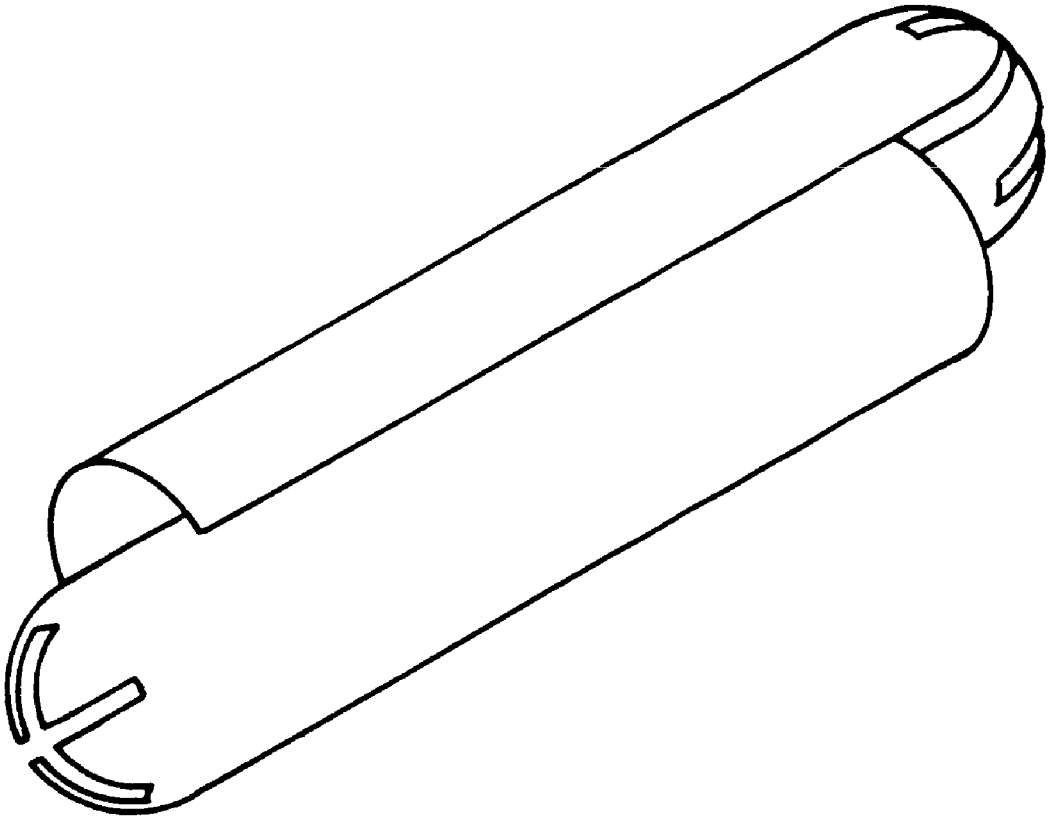
FIG. 1 (PRIOR ART)
FIG. 1 illustrates two shoelace anglets hooked up with each other according to the prior art.
Figure 3:
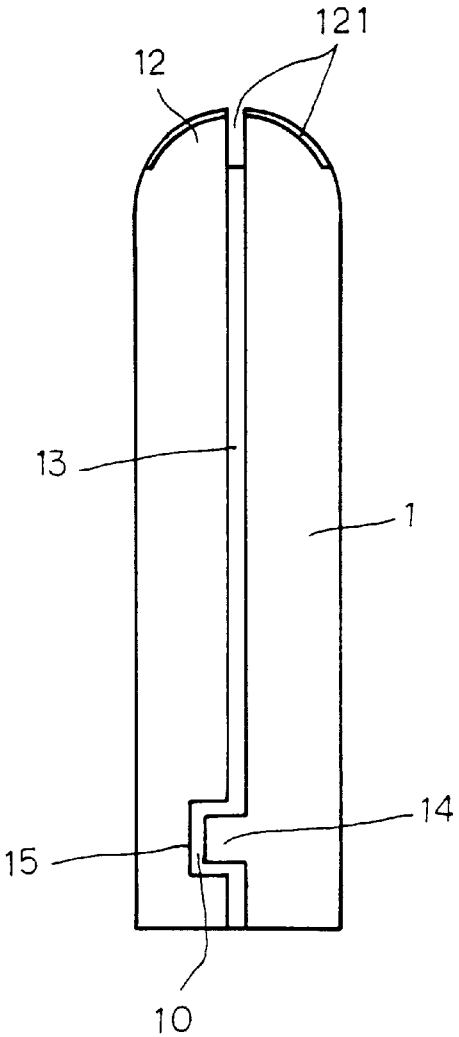
FIG. 3 is a plain view of the shoelace anglet shown in FIG. 2.
Figure 2:
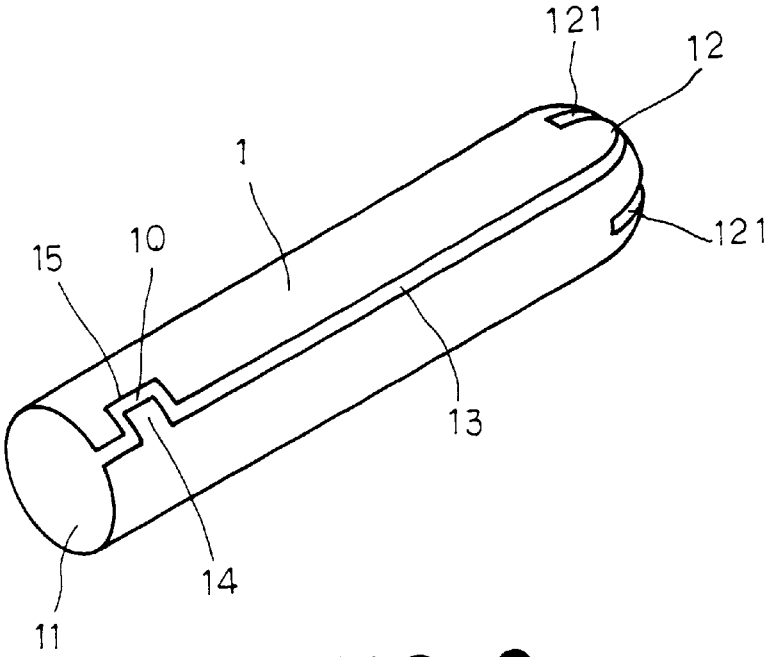
FIG. 2 is an elevational view of a shoelace anglet according to a first embodiment of the present invention.

Referring to FIG. 2~3, an anglet in accordance with the present invention comprises a metal anglet body 1 shaped like an elongated, cylindrical, split cap. The anglet body 1 has a front opening 11 at one end, a rounded head 12 at the other end, an end slot of any of a variety of shapes, for example, a crossed end slot 121 in the rounded head 12, and a split 13 extended between the crossed end slot 121 and the front opening 11. Further, a protruding portion 14 and a recessed portion 15 are respectively formed integral with the anglet body 1 at two sides of a curved part 10 of the split 13 near the front opening 11. The protruding portion 14 projects into the recessed portion 15. Because the protruding portion 14 is engaged into the recessed portion 15, shoelace anglets do not hook up with one another when put together.

Figure 4:
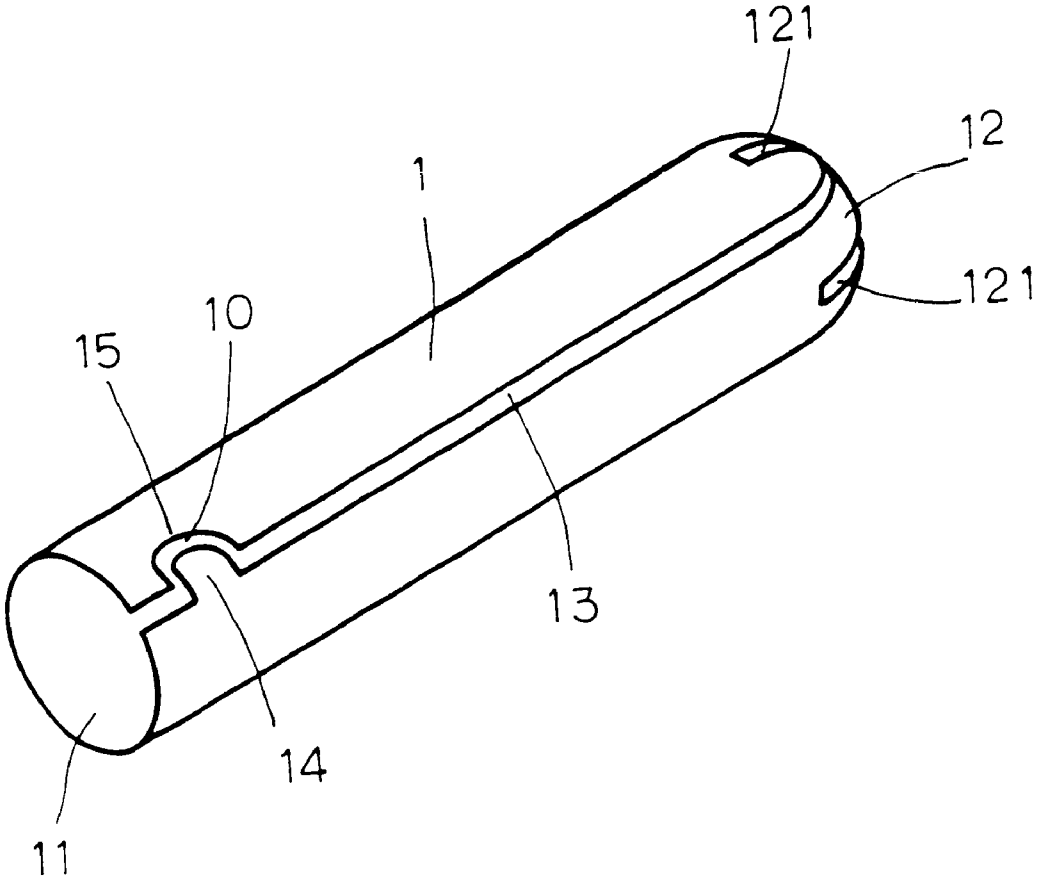
FIG. 4 is an elevational view of an alternate form of the shoelace anglet according to the present invention.
Figure 5:
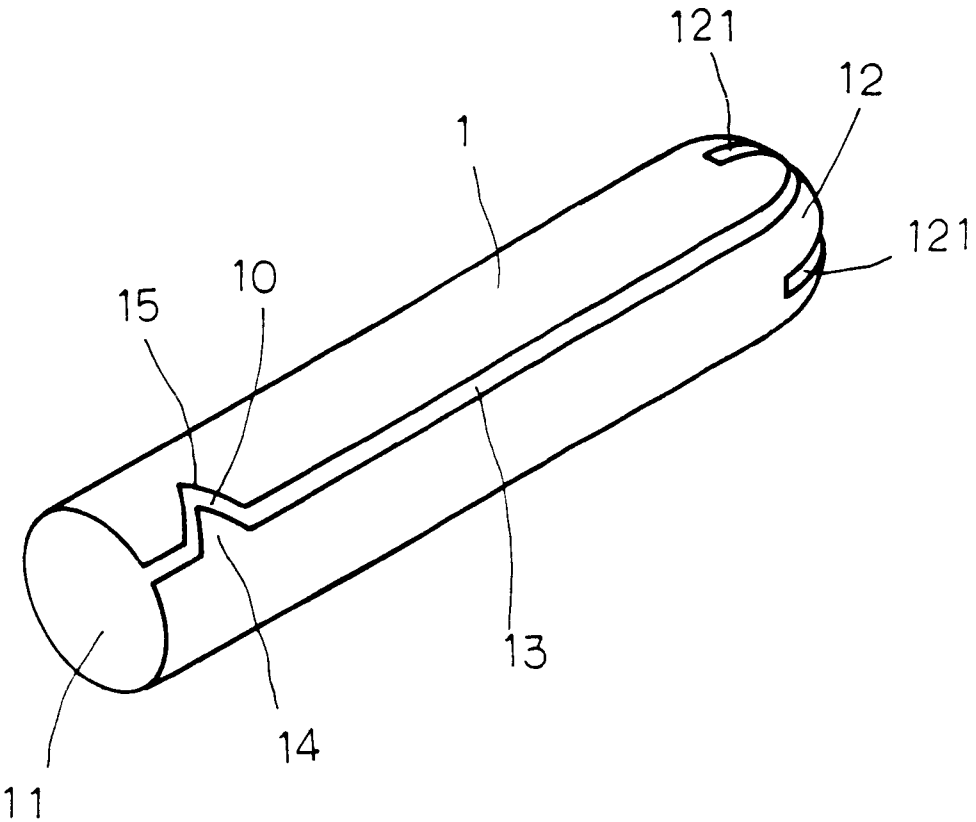
FIG. 5 is an elevational view of another alternate form of the shoelace anglet according to the present invention.
Figure 7:
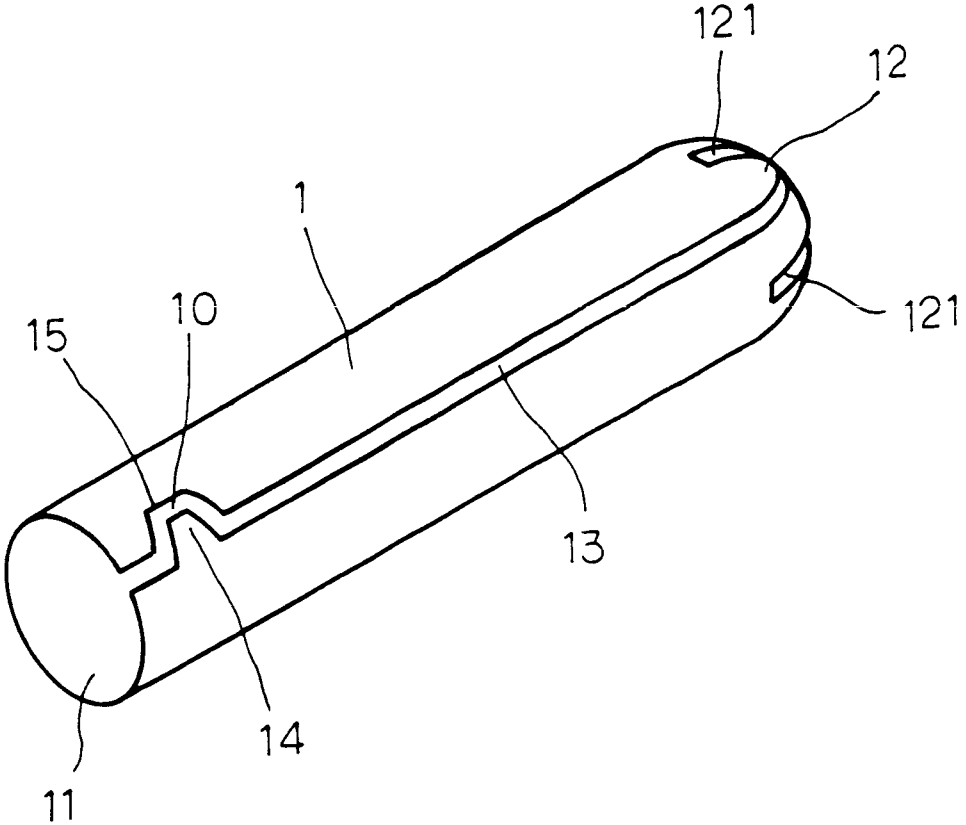
FIG. 7 is an elevational view of still another alternate form of the shoelace anglet according to the present invention.

The aforesaid protruding portion 14 and recessed portion 15 are a good match, and can be made having any of a variety of shapes, for example, the rectangular shape shown in FIGS. 2 and 3, the smoothly arched shape shown in FIG. 4, the triangular shape shown in FIG. 5, or the trapezoidal shape shown in FIG. 7.

Figure 6:
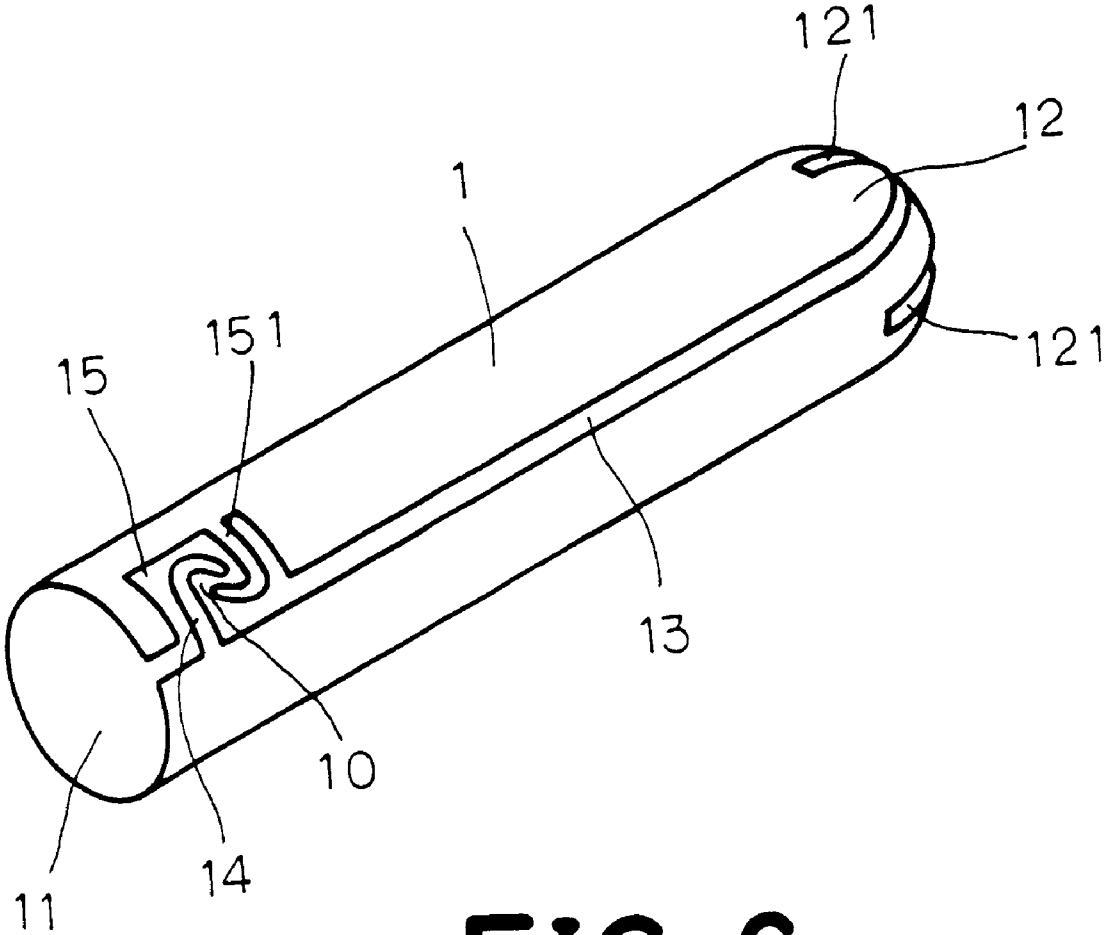
FIG. 6 is an elevational view of still another alternate form of the shoelace anglet according to the present invention.

FIG. 6 shows still another alternate form of the present invention. According to this alternate form, the anglet body 1 comprises a front opening 11 at one end, a rounded head 12 at the other end, an end slot of any of a variety of shapes, for example, a crossed end slot 121 in the rounded head 12, a split 13 extended between the crossed end slot 121 and the front opening 11, a first hooked protruding portion 14 and a recessed portion 15 respectively disposed at two sides of a curved part 10 of the split 13, and a second hooked protruding portion 14 suspending in the recessed portion 15 and hooked up with the first hooked protruding portion 14.

Figure 8:
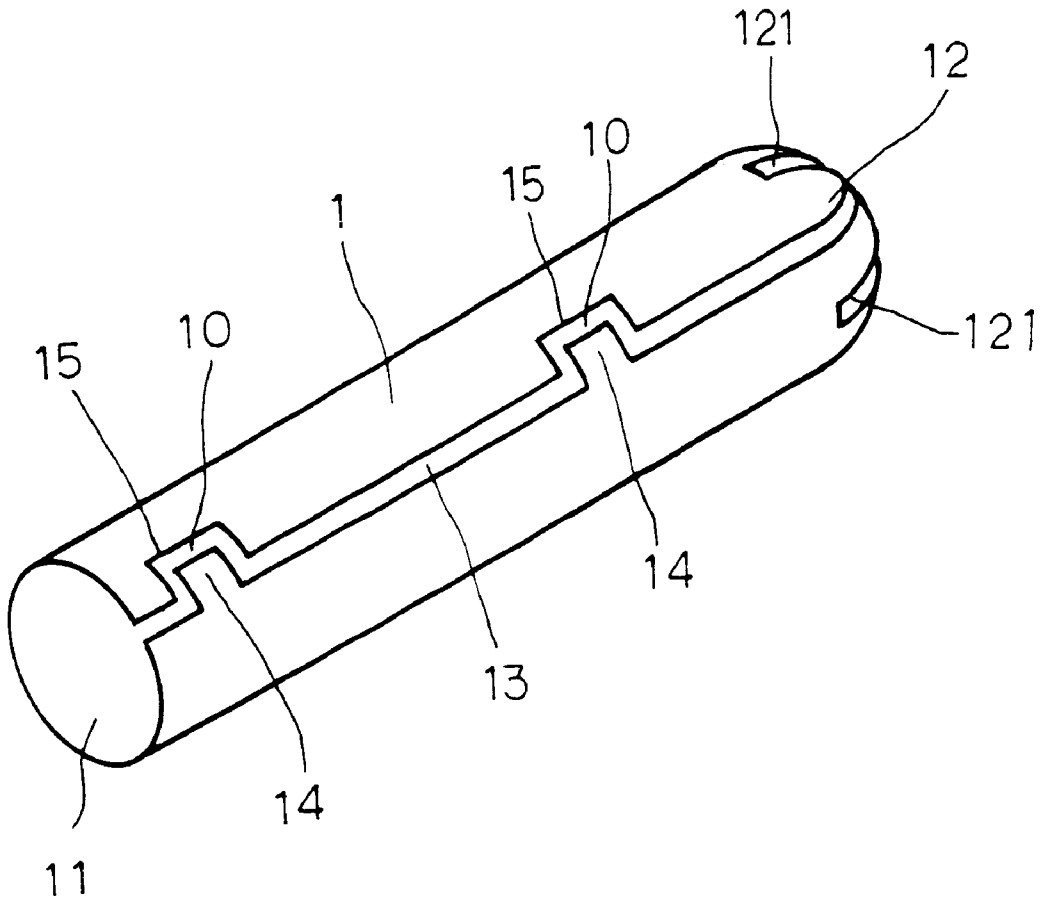
FIG. 8 is an elevational view of still another alternate form of the shoelace anglet according to the present invention.

FIG. 8 shows still another alternate form of the present invention. According to this alternate form, two protruding portions 14 and two recessed portions 15 are symmetrically disposed at two sides of a respective curved part 10 of the split 13.

A prototype of shoelace anglet has been constructed with the features of FIGS. 1~8. The shoelace anglet functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A shoelace anglet comprising an elongated, cylindrical, split cap-like metal anglet body having a front opening at one end thereof, a rounded head at an opposite end thereof, an end slot in said rounded head, and a split extended between said end slot and said front opening, wherein said anglet body further comprises at least one protruding portion disposed at a first side of said split near said front opening, and at least one recessed portion disposed at a second side of said split opposite to said first side and adapted to receive said at least one protruding portion respectively.

2. The shoelace anglet of claim 1 wherein said at least one protruding portion and said at least one recessed portion have a rectangular profile.

3. The shoelace anglet of claim 1 wherein said at least one protruding portion and said at least one recessed portion have an arched profile.

4. The shoelace anglet of claim 1 wherein said at least one protruding portion and said at least one recessed portion have a triangular profile.

5. The shoelace anglet of claim 1 wherein said at least one protruding portion and said at least one recessed portion have a trapezoidal profile.

6. The shoelace anglet of claim 1 wherein said anglet body further comprises at least one second protruding portion respectively disposed at the second side of said split and suspended in said at least one recessed portion and adapted to hook up with the at least one protruding portion at a first side of said split.

* * * * *